United States Patent [19]

Kirby et al.

[11] 4,305,342

[45] Dec. 15, 1981

[54] BARGE-CARRYING VESSEL OF THE FLOTATION LOADING AND UNLOADING TYPE WITH WEDGE MEANS FOR HOLDING DOWN THE BARGES

[75] Inventors: William E. Kirby, Hong Kong, Hong Kong; David J. Seymour, Daly City, Calif.

[73] Assignee: Wharton Shipping Corporation, Edificio Vallarino, Panama; by David J. Seymour

[21] Appl. No.: 108,466

[22] Filed: Dec. 31, 1979

[51] Int. Cl.[3] ..... B63B 35/40

[52] U.S. Cl. ..... 114/260; 410/141; 410/142

[58] Field of Search ..... 114/259, 260, 72, 73, 114/75; 410/121, 140, 141, 142

[56] References Cited

U.S. PATENT DOCUMENTS

| | | | |
|---|---|---|---|
| Re. 30,040 | 7/1979 | Kirby et al. | 114/260 |
| 2,961,271 | 11/1960 | Morris | 410/140 X |
| 3,722,449 | 3/1973 | Goldman | 114/260 X |
| 3,722,736 | 3/1973 | Goldman | 114/260 X |
| 3,978,806 | 9/1976 | Kirby et al. | 114/43.5 VC |
| 4,135,468 | 1/1979 | Kirby et al. | 114/260 |
| 4,147,123 | 4/1979 | Kirby et al. | 114/260 |

FOREIGN PATENT DOCUMENTS

| | | | |
|---|---|---|---|
| 2263147 | 10/1975 | France | 114/259 |

*Primary Examiner*—Joseph F. Peters, Jr.
*Assistant Examiner*—Donald W. Underwood
*Attorney, Agent, or Firm*—Owen, Wickersham & Erickson

[57] ABSTRACT

A barge-carrying vessel of the flotation loading and unloading type. Each barge-stowage hold has parallel, vertical side walls that are only slightly further apart from each other than the width of the barges to be stowed. The barges are held down against the bottom of the hold, enabling transfer of buoyancy from the barges to the vessel when the hold is flooded. For this purpose, a series of guides is secured to one side wall of the hold, each guide comprising a pair of parallel vertical tracks. In between each pair of tracks is a wedge having a sloping outer face for engagement with a barge in a wedging manner to force this barge against the opposite side wall. The wedges are raised and lowered as needed, and are positively secured in place in their barge-hold down position.

5 Claims, 7 Drawing Figures

BARGE-CARRYING VESSEL OF THE FLOTATION LOADING AND UNLOADING TYPE WITH WEDGE MEANS FOR HOLDING DOWN THE BARGES

BACKGROUND OF THE INVENTION

This invention relates to a barge transportation system in which a carrier vessel is used to transport a number of barges across a sea or other vast expanse of water. The vessel is the type that is loaded by floating the barges in and unloaded by floating them out.

In systems of this type (which are shown, for example, in our U.S. Pat. Nos. Re. 30,040, 3,978,806, 4,135,468 and 4,147,123) is quite important to hold the barges down against the bottom of the hold, so that a transfer of buoyancy is achieved at times when the hold is flooded. This holding down is important even when the hold is normally dried out during transport, when it acts as a safety feature in case the vessel springs a leak that might endanger the ship, as during storms. It is also important for simply retaining the barges in place against shifting.

Various hold-down systems have been shown in our U.S. Pat. Nos. Re. 30,040, 3,978,806, 4,135,468, and 4,147,123. The present invention relates to a simple such system that can be set into action by the crew and which also is relatively low in cost, both in installation and in application, while at the same time being quite reliable.

Among the objects of the invention are the provision of a new hold-down system in a barge transport vessel of the type in which the barges are floated in and out of the hold in which they are stowed, and the provision of an especially efficient and relatively inexpensive and very effective hold-down system.

SUMMARY OF THE INVENTION

The invention is a barge-carrying vessel of the type employing flotation loading and flotation unloading of barges into its hold or holds. Each hold is bounded by a pair of parallel, vertical side walls which are somewhat, but not greatly, further apart from each other than the width of the barges to be stowed in that hold.

Stowed barges are positively held down against the bottom of the hold, enabling transfer of buoyancy from the barges to the vessel when the hold is flooded. The hold-down means comprises a series of guide means secured to one side wall of the hold, each guide means comprising a pair of parallel vertical tracks. Between each pair of tracks is a wedge having a sloping outer face for engagement with a barge in a wedging manner, forcing the barge up against the opposite wall. The invention also preferably includes powered wedge lifting means for positively securing each wedge in place in its wedging, barge-hold-down position. For example, wedge locking means may comprise a series of horizontal openings in each track, those of one track of each pair being aligned with those of the other track of that pair, a horizontal through opening through each wedge, alignable with the openings through the tracks when the wedge is in its locking position, and a locking pin for passing horizontally through the track for releasably locking the pin in place. There may be a second smaller pin for locking the locking pin in place. Access by the crew is provided for enabling the locking and unlocking.

Other objects and advantages of the invention will appear from the following description of the preferred embodiment thereof.

DESCRIPTION OF A PREFERRED EMBODIMENT

Figure 1:
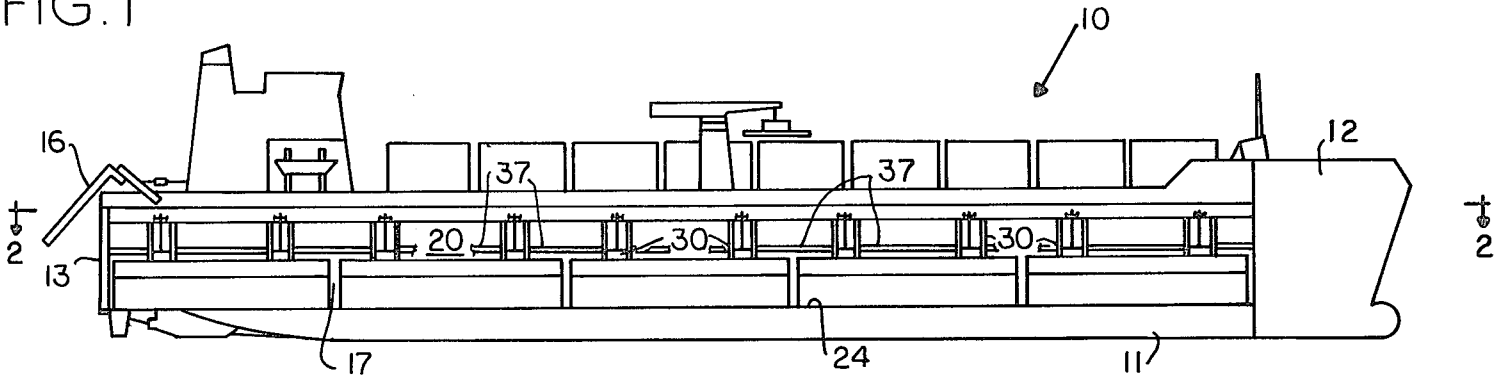
FIG. 1 is a view in side elevation and in section of a vessel embodying the principles of the invention; the section is taken along the line 1—1 in FIG. 2.
Figure 2:
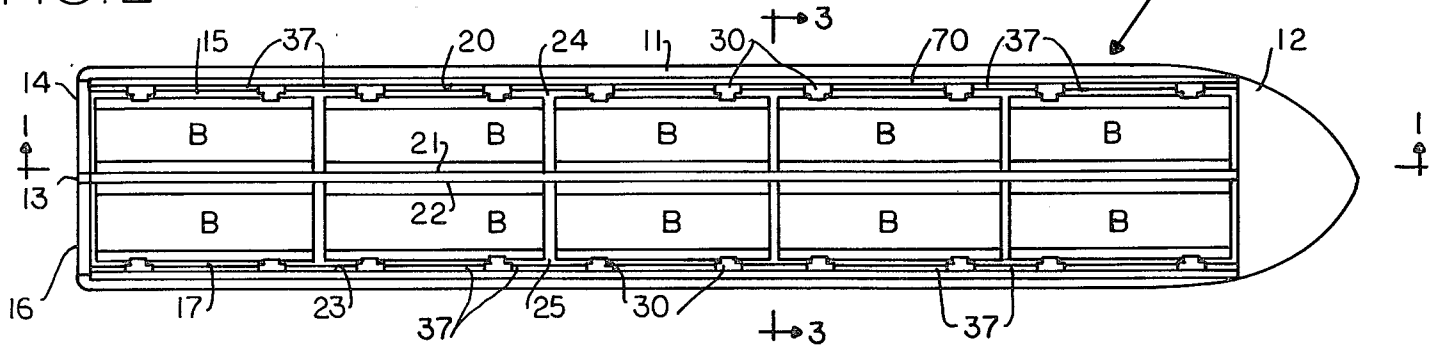
FIG. 2 is a plan view of one of the holds of the vessel of FIG. 1 taken along the line 2—2 in FIG. 1.
Figure 7:
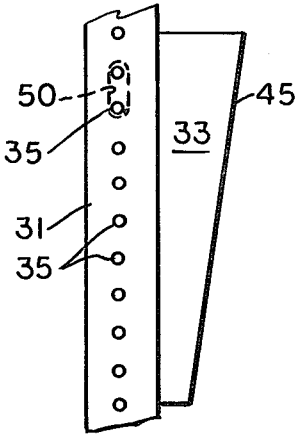
FIG. 7 is similar view of the wedge and its' girders, on a different scale.
Figure 6:
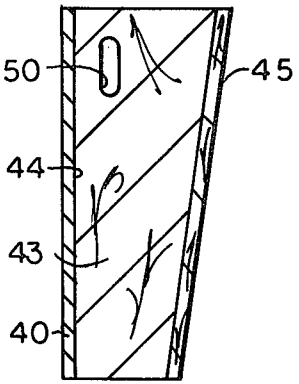
FIG. 6 is a further enlarged view in side elevation and partly in section of one of the wedges.
Figure 3:
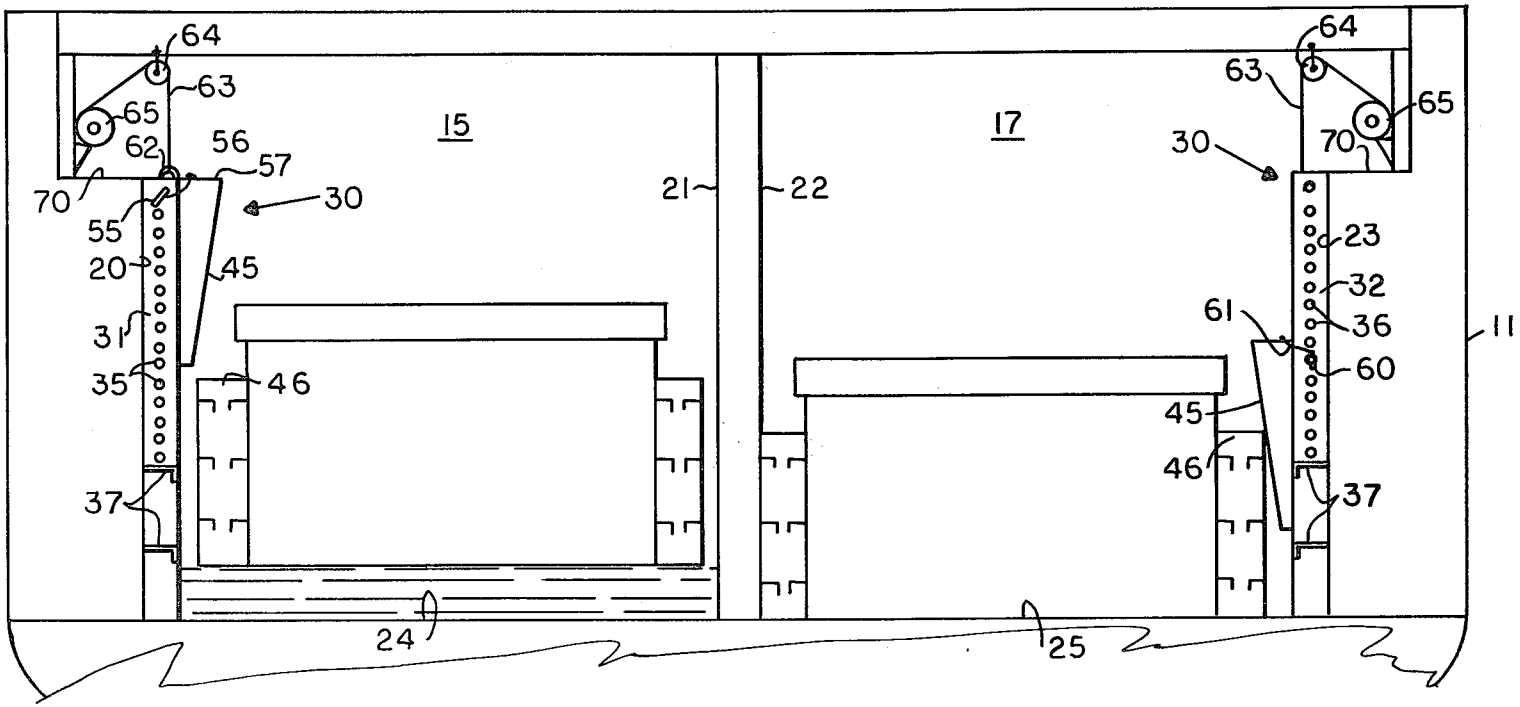
FIG. 3 is an enlarged view in section, taken along the line 3—3 of FIG. 2 showing one barge firmly held down by apparatus embodying the principles of the invention and another barge, just loaded aboard, on its way to being held down.
Figure 4:
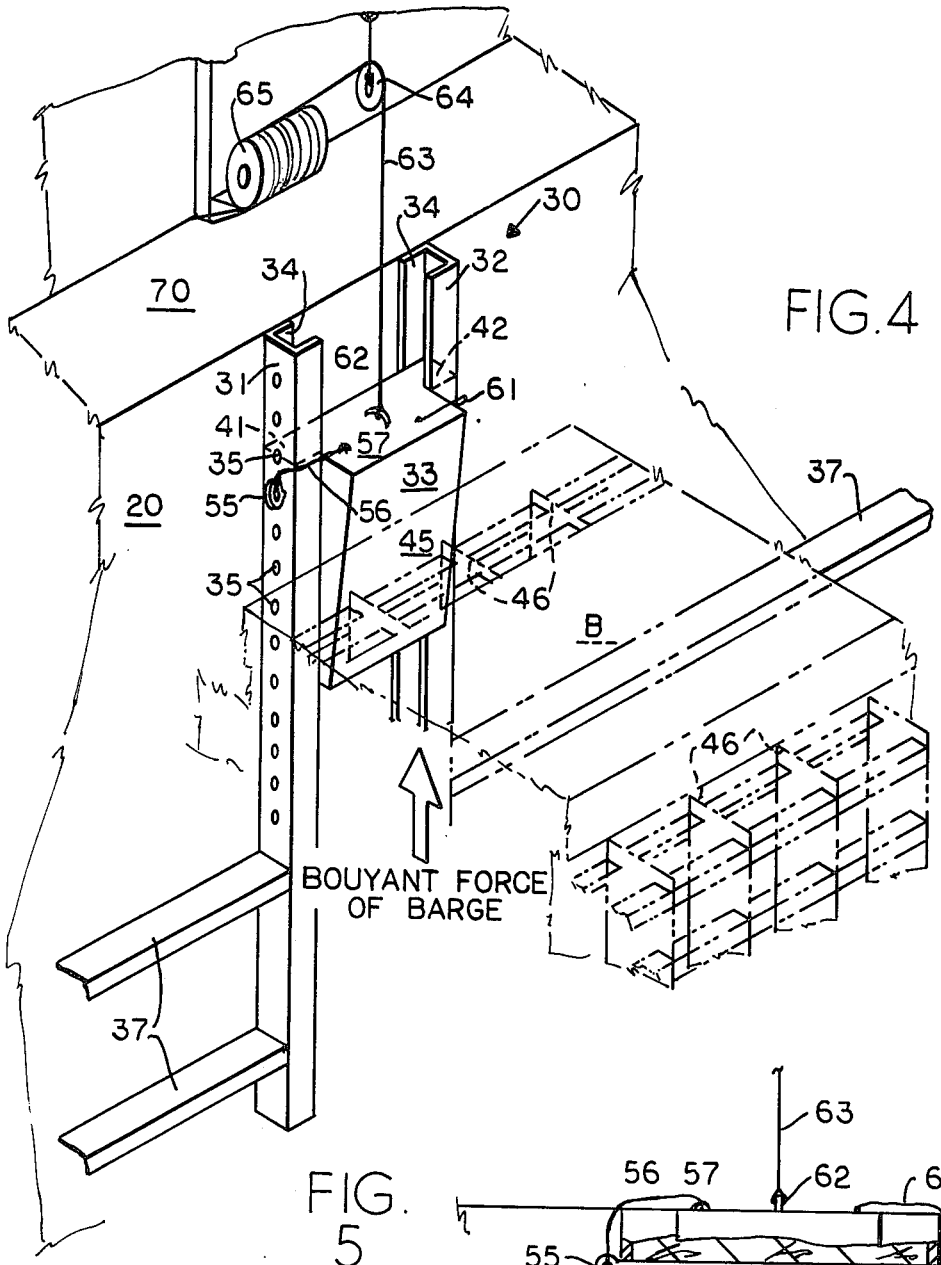
FIG. 4 is a further enlarged fragmentary view in perspective of a portion of one of the wedge apparatus with its track and accompanying winch.
Figure 5:
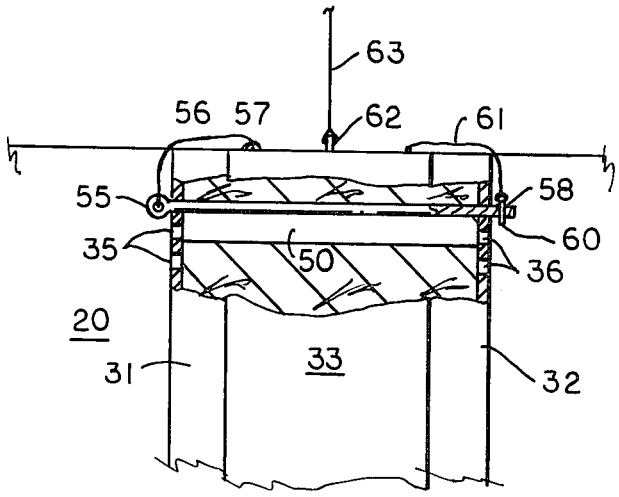
FIG. 5 is a view in elevation and partly in section of the locking device in conjunction with the wedge shown in a locked position.

FIG. 1 shows a vessel 10 of a type which may be used for barge transport. It has a hull 11 with a bow 12 and a stern 13, and there is a gate 14 in the stern leading into a hold 15, and (as shown in the drawing) there may also be a stern gate 16 leading into a hold 17. There may also be a bow gate or gates, if desired, or it may have a gate in the bow only, if desired. In any event, the gate or gates give access to one or more holds 15, 17 which barges B are to be loaded by flotation loading and stowed. As shown in FIGS. 2 and 3, each hold 15, 17 has a pair of parallel, vertical side walls 20, 21 and 22, 23 extending the length of the holds 15 and 17, and also a bottom 24, 25. The vessel 10 is also provided with buoyancy tanks for raising and lowering the water line of the vessel.

As described in our earlier patents, referred to above, there is apparatus for flooding each hold, such apparatus not being described here.

For loading barges B into the holds 15 and 17, the holds 15 and 17 are first flooded, and then the gates 14 and 16 are opened. The barges B are then floated into the flooded holds 15 and 17. The gates 14 and 16 may then be closed and the water pumped out from the holds 15 and 17. For unloading, the holds 15 and 17 are again flooded, and the gates 14 and 16 opened, and the barges B floated out; the holds may then be reloaded with other barges, and the gates 14 and 16 closed.

As stated above, it is important that the barges B be firmly held down on the hold bottom 24, 25. The invention calls for the hold-down apparatus to be of a wedge type, in which wedges are one side wall of each hold, urge the barges against the opposite side wall and the bottom. For this purpose, the two side walls 20, 21 or 22, 23 are spaced apart in each hold by a distance that is somewhat greater but not very much greater than the beam of the barges B.

Along one side wall 20, 23 of each hold 15, 17 is a series of guide means 30, which may comprise, in each instance, a pair of vertically extending tracks 31 and 32, and, in between these tracks, is a wedge member 33. Preferably, the tracks 31 and 32 have flanges 34 which restrain the wedge from moving in or out or, in other words, away from or closer to the wall 20 or 23 upon which the tracks 31 and 32 are provided with a series of openings 35, 36 therethrough, with each track 31 of the pair having its openings 35 aligned with the openings 36 of the other track 32. To prevent damage to the guide means 30 and to the wedge 33, a plurality of fender means 37 may extend between successive guide means 30, from a track 32 to a track 31.

The wedge 33 is provided with a wide base member 40 that provides a pair of projections 41 and 42 that fit within the flanges 34 and that can slide up-and-down there. This base member 40 may be of steel. Secured to it is a wooden member 43 having a vertical inner face 44 secured to the base 40 one having a sloping outer face 45 to provide the wedge effect. The slope depends upon the overall dimensions. Basically, the wedge face 45 should extend out far enough so that it will force the barge B up against the other wall 21, 22. The wedge 33 is activated and put into its wedging position while there is still some water in the hold 15 and 17 and help the barge B move easily against the wall 21 or 22 when the wedge 33 is forced down. After the water has been pumped from the holds 15 and 17, the wedges 33 may each be lifted again and dropped down to secure a firm wedging action.

The wedge 33 is made wide enough so that it will always engage at least one barge frame member. In other words, the barges B all have laterally extending frame members 46 that are spaced apart longitudinally; if they are spaced four feet apart, the wedge face 45 would be about four feet wide.

The upper thickest part of the wedge 33 is thick enough so that the wedge 33 will engage and retain any barge to be stowed in its hold when the barge is up against the opposite side wall 21 or 22. In other words, the upper portion of the face 45 stands out from the wall 20 or 23 by a distance greater than the amount by which the hold 15 or 17 is wider than the barge B to be stored therein. The slope of the face 45 enables accomodation of tolerances and enables a gentle urging of the barge toward the position where it abutts the opposite wall.

Preferably, the outer portion of the wedge is made from wood, to prevent damage to the barge. It may be laminated, with hard wood, such as oak making up the bulk of the wedge and softwood, such as fir or pine making up the outer inch or two, thereby achieving a strong solid portion with a more yieldable outer portion.

The wedge itself preferably has at least one and may have several openings 50 extending horizontally from side-to-side, which can be aligned with the openings 35 in the tracks 31 during the time when the wedge is fully in place.

A pin 55 which may be secured by a lanyard 56 to the upper surface 57 of the wedge 33 so that it will not be lost, can then be inserted through one hole 35 of one track 31 through the opening 50 through the wedge 33 and then out the hole 35 of the other track 32. This pin 55 may be provided with an opening 58 therethrough which a second, smaller pin 60 may be inserted, and this then may also be attached by a lanyard 61 to the wedge 33.

Staple 62 or similar member at the upper end 57 of the wedge 33 enables attachment of the winch cable 63, which may go up from the wedge 33, over a pulley 64 to a winch 65 which is preferably power-driven. Each winch 65 may be operated separately, or they may, if desired, be ganged to operate together.

As it may be noted, there may be a number of these wedge tracks 31, 32 and wedges 33 along the full length of the barge holds 15 and 17, depending upon the type of the barge. There should be at least two of these even for small barges, and for larger barges it is advisable to have several.

In operation, when the gates 14 and 16 are raised the barge B is floated into the hold, 15 and 17, and when a sufficient number of barges are in to constitute the cargo, the gates 14 and 16 are closed.

While the water is being pumped out from the holds 15 and 17, the wedges 33 may be lowered to force the barge over against the opposite side wall. When the hold has been dried, the wedges 33 may be tightened somewhat if that is necessary. Access by a walkway 70 is provided so that a man can put the locking pin 55 in place and also attach the security pin 60 that goes through the locking pin 55 to retain it in place.

Before unloading, these pins 60 and 55 are removed, and the winch 60 raises the wedges 33 out of contact with barges. Then the hold is flooded, and the barges may be floated out. Various systems may be used for moving the barges within the hold, as disclosed in some of the patents previously mentioned.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. A barge-carrying vessel of the type having at least one barge-storing hold and means enabling flotation loading and flotation unloading of barges into said hold, comprising a pair of generally parallel generally vertical side walls in said hold somewhat but not greatly further apart from each other than the width of the barges to be stowed therein, and a bottom wall, and hold-down means for holding down stored barges against the bottom of the hold, enabling transfer of buoyancy from the barges to the vessel when the hold is flooded said hold-down means comprising a series of guide means secured to one said side wall only of said hold and each comprising a pair of parallel vertical tracks, a wedge between each pair of tracks, having a sloping outer face engaging a said barge in a wedging manner when said barge is in position to enable said transfer of buoyancy, wedge lifting means for raising and lowering each said wedge, and wedge locking means for securing each said wedge to its said guide means at any of several possible positions and providing buoyancy forces, acting on the barge when the hold is flooding, from lifting the wedge out of its barge-hold-down position.

2. The vessel of claim 1 having fender means extending between successive guide means for fending the barges away from damaging said guide means and said wedges.

3. The vessel of claim 1 wherein said wedge locking means comprises:

a locking pin for each wedge longer than the distance between said parallel tracks, a vertical series of horizontal openings through each of said tracks, with the openings in one said track being in horizontal alignment with the openings in the other said track, a horizontal opening through said wedge for alignment with said track openings enabling insertion of said locking pin through both said tracks and said wedge.

4. The vessel of claim 3 wherein said opening through said wedge is vertically elongated enough so that said locking pin can at all times be inserted through a pair of opening in each track and still pass through the openings through said wedge.

5. The vessel of claim 3 wherein said locking pin has a head portion at one end and latching opening through its other end, and a second locking pin is provided for extending through said latching opening to prevent accidental retraction of said locking pin after installation.

* * * * *